US005459955A

United States Patent [19]

Ruskouski et al.

[11] Patent Number: 5,459,955

[45] Date of Patent: Oct. 24, 1995

[54] LIGHTING DEVICE USED IN AN EXIT SIGN

[75] Inventors: Charles R. Ruskouski, Danbury; James J. Burnes, Deep River; James R. Carson, Oxford, all of Conn.; Hilario S. Costa, Sarasota, Fla.

[73] Assignee: General Signal Corporation, Stamford, Conn.

[21] Appl. No.: 160,587

[22] Filed: Dec. 1, 1993

[51] Int. Cl.[6] ..... F21V 17/04

[52] U.S. Cl. ..... 40/570; 40/564; 362/282; 362/812; 362/800

[58] Field of Search ..... 40/564, 570, 572, 40/582; 362/237, 241, 800, 817, 282

[56] References Cited

U.S. PATENT DOCUMENTS

| | | | |
|---|---|---|---|
| 844,087 | 2/1907 | Bellamy . | |
| 859,199 | 7/1907 | Chinnery . | |
| 2,915,844 | 12/1959 | Thomas . | |
| 3,309,806 | 3/1967 | Gallagher . | |
| 3,324,290 | 6/1967 | Lasker . | |
| 3,560,729 | 2/1971 | Liberman . | |
| 3,864,861 | 2/1975 | Hill, Jr. . | |
| 4,139,957 | 2/1979 | Minoque . | |
| 4,211,955 | 7/1980 | Ray | 315/53 |
| 4,234,914 | 11/1980 | Boesen . | |
| 4,254,453 | 3/1981 | Mouyard et al. | 362/240 |
| 4,259,800 | 4/1981 | Schoenfeld . | |
| 4,271,408 | 2/1981 | Teshima et al. . | |
| 4,298,869 | 11/1981 | Okuno | 340/782 |
| 4,345,308 | 8/1982 | Mouyard et al. . | |
| 4,383,382 | 5/1983 | Hegarty | 40/545 |
| 4,435,743 | 3/1984 | Plumly | 362/20 |
| 4,443,835 | 4/1984 | Bräutigam et al. . | |
| 4,630,183 | 12/1986 | Fujita | 362/311 |
| 4,682,147 | 7/1987 | Bowman | 340/286 |
| 4,720,709 | 1/1988 | Imamura et al. . | |
| 4,724,629 | 2/1988 | Walton | 40/451 |
| 4,727,289 | 2/1988 | Uchida | 315/71 |
| 4,768,300 | 9/1988 | Rutili . | |
| 4,782,429 | 11/1988 | Walton et al. | 362/20 |
| 4,849,864 | 7/1989 | Forrest . | |
| 4,884,178 | 11/1989 | Roberts . | |
| 4,929,866 | 5/1990 | Murata et al. . | |
| 4,951,406 | 8/1990 | Lemire . | |
| 4,965,457 | 10/1990 | Wrobel et al. | 362/249 |
| 4,967,317 | 10/1990 | Plumly . | |
| 4,991,063 | 2/1991 | Stoneham | 362/882 |
| 5,012,157 | 4/1991 | Walton et al. | 315/66 |
| 5,018,290 | 5/1991 | Kozek et al. | 40/570 |
| 5,020,252 | 6/1991 | De Boef . | |
| 5,036,248 | 7/1991 | McEwan et al. . | |
| 5,105,568 | 4/1992 | Branning . | |
| 5,136,483 | 8/1992 | Schöniger et al. . | |
| 5,160,201 | 11/1992 | Wrobel | 362/249 |
| 5,268,828 | 12/1993 | Miura . | |
| 5,276,591 | 1/1994 | Hegarty . | |
| 5,299,109 | 3/1994 | Grondal . | |
| 5,303,124 | 4/1994 | Wrobel . | |
| 5,410,453 | 4/1995 | Ruskouski | 362/20 |

FOREIGN PATENT DOCUMENTS 22990 of 1913 United Kingdom .

OTHER PUBLICATIONS

Brochure–Astralite 2000 LED Exit Sign Retrofit Kit Single Sided L.E.D. Retrofit Kit Instructions.
Dual–Lite brochure–We've Created A Masterpiece. Again.
Brochure–The Lumacell Leader (LER Universal Retrofit Module).
LPR Installation Instructions—Isolite.
Brochure–Model LPR Retrofit Module–Isolite.
Brochure—The Lumacell Leader (LER Series Module).
Brochure—Isolite's New LitePak.

*Primary Examiner*—Kenneth J. Dorner
*Assistant Examiner*—Cassandra Davis
*Attorney, Agent, or Firm*—Ware, Fressola, Van Der Sluys & Adolphson

[57] ABSTRACT

In lighting fixture such as an exit sign, a light emitting diode lighting device is provided for mating engagement with an electrical socket of the lighting fixture. The light emitting diode lighting device has a plurality of light emitting diodes with a light directing member spaced therefrom for directing light into a desired illumination pattern. The light directing member can be wedge or parabola shaped.

37 Claims, 10 Drawing Sheets

LIGHTING DEVICE USED IN AN EXIT SIGN

BACKGROUND OF THE INVENTION

The present invention relates generally to electrical lighting sources and, more particularly, to electrical lighting sources in illuminated exit signs.

Under current local fire and building codes, buildings to which the public has access are required to have signage therein identifying the exits. Most of these signs are required to exhibit a specific amount of illumination and, oftentimes, must have an emergency backup power source to provide emergency illumination to the light for a specified period of time during periods when utility power to the building is discontinued, thereby facilitating egress of persons from the building.

Traditionally, two 15-watt incandescent lamps driven by 120 volt alternating current (120 VAC) have been employed to provide normal illumination while two 3.6-watt incandescent lamps driven by a self contained emergency battery power supply are used for illumination during power failure situations. A switching or transfer device will automatically operate the emergency backup illumination system when a power failure is detected.

While these traditional exit sign lighting arrangements perform adequately, they do have a few drawbacks. A major drawback is that the incandescent bulbs use large amounts of electric power thus requiring a relatively large emergency battery power supply for use during emergency lighting situations. Furthermore, while the incandescent bulbs provide adequate illumination, such bulbs do not have a long life in service and require frequent replacement.

To alleviate the drawbacks associated with incandescent bulbs, many manufacturers are beginning to utilize light emitting diodes (LEDs) rather than incandescent bulbs in exit signs. Each light emitting diode provides a relatively small amount of light as compared to the traditional incandescent bulbs whereby a large number of light emitting diodes must be used to provide the same amount of illumination offered by the traditional incandescent bulbs.

It is an object of the present invention to provide a novel lighting device for an exit sign using a plurality of light emitting diodes.

It is also an object to provide such a lighting device which allows the light emitting diodes to be powered by both the normal utility electrical power (120 VAC) and, during emergency power situations, an emergency battery power supply and associated charging and transfer circuitry.

Still another object is to provide such a lighting device in which the light emitting diodes are arranged in the exit sign to provide the amount of illumination required by building codes.

A further object is to provide such a lighting device which may be readily and economically fabricated and will enjoy a long life in operation.

SUMMARY OF THE INVENTION

It has now been found that the foregoing and related objects can be readily attained in an exit sign connectable to a primary electrical power source and having a sign housing, a primary electrical power circuit and at least one lighting device. The sign housing defines an enclosure therein and has indicia to be illuminated. The primary electrical power circuit is adapted to be connected to the primary electrical power source and is electrically connected to the at least one lighting device. The at least one lighting device is positioned within the sign housing enclosure for illuminating the indicia.

Each lighting device has a lighting device housing which defines a lighting device enclosure. A plurality of light emitting diodes extend from the lighting device housing. A light directing member is spaced from the plurality of light emitting diodes for directing light from the light emitting diodes into the enclosure to illuminate the indicia of the sign housing. The light directing means can have a wedge or parabola shape.

In order to obtain a variety of illumination patterns, the light directing member is moveable relative to the light emitting diodes. To space the light directing member from the light emitting diodes, the lighting device housing has two legs extending therefrom and the light directing member extends between the two legs. The light directing member is connected to the legs for pivotal and rectilinear movement relative to the light emitting diodes to obtain the variety illumination patterns.

According to the invention, the plurality of light emitting diodes are mounted on a printed circuit board positioned in the enclosure of the lighting device housing. The printed circuit board is electrically connected to and has electrical components for the plurality of light emitting diodes Desirably, the exit sign has an emergency electric power supply to provide auxiliary power to the light emitting diodes in event of failure of the primary electrical power source. The emergency electric power supply is at least one rechargeable battery and includes a charging device for keeping the at least one rechargeable battery fully charged during periods of nonuse. The emergency electrical power supply is mounted within the lighting device housing or outside the lighting device housing inside the exit sign housing. The emergency electric power supply is operationally connected to the primary electric power circuit to detect failure of the primary electrical power source and thereafter provided auxiliary power to the at least one lighting device.

Ideally, a mounting base assembly is provided on the lighting device housing for electrically connecting the light emitting diodes to an electrical socket in the lighting device housing. The mounting base assembly is matingly received in the electrical socket through relative rotational and axial movement therebetween. The mounting base assembly permits orientation of the lighting device housing relative to the mounting base assembly.

Preferably, the at least one lighting device is two lighting devices spaced from one another within the enclosure to fully illuminate the indicia. The two lighting devices can have their respective light emitting diodes facing one another or can have their respective light emitting diodes facing away from one another.

The invention will be fully understood when reference is made to the following detailed description taken in conjunction with the accompanying drawings.

DETAILED DESCRIPTION OF THE INVENTION

Figure 1:
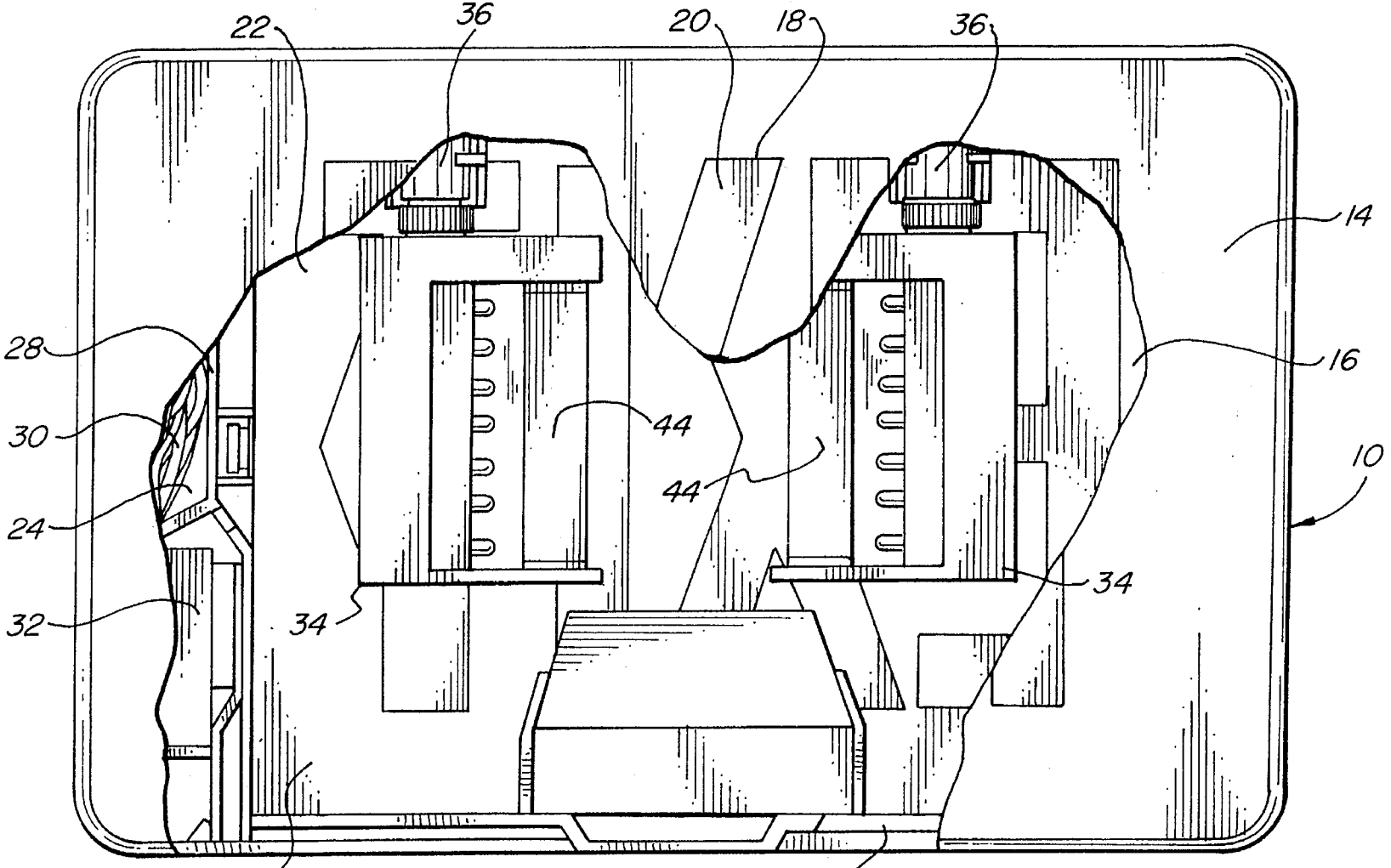
FIG. 1 is a side elevational view of an exit sign housing with portions removed and broken away to illustrate internal structure including two light emitting diode lighting devices made in accordance with the first embodiment of the present invention.

Referring first to FIG. 1 of the drawings, therein illustrated is an exit sign generally designated by the numeral 10. The exit sign 10 is mountable to both a canopy bracket (not shown) and a standard electrical junction box (not shown) in a manner explained in copending U.S. patent application Ser. No. 07/925,313, U.S. Pat. No. 5,272,605, entitled CANOPY MOUNTING DEVICE FOR EXIT SIGNS AND THE LIKE. With this arrangement, the exit sign construction of this invention can be mounted directly to a standard electrical junction box found in a ceiling or wall of a building in any desired location.

The exit sign 10 comprises a central rectangularly shaped frame 12 with front and back cover members 14 and 16, at least one of which incorporates a large stencil 18 having the letters "EXIT" in the major surface thereof and a colored plastic diffuser 20 therebehind. The central rectangularly shaped frame 12 and the front and back cover members 14 and 16 are snap-fit together and cooperate to form a housing having an enclosure 22 containing the necessary internal electrical lighting components. The front and back covers 14, 16 can use a plurality of finger clips (not shown) to hold them in assembly with the central rectangularly shaped frame 12. The exit sign 10 is preferably molded from a plastic resin such as an engineering type thermoplastic such as ABS, polycarbonate or polyphelyene oxide but it should be apparent to those skilled in the art that they may be manufactured from other suitable materials.

The enclosure 22 of the exit sign 10 is divided into a wiring compartment 24 and a lighting compartment 26 by a retaining wall 28 which extends around the interior sides and top of the central rectangularly shaped frame 12. In a manner explained further hereinafter, the wiring compartment 24 contains an appropriate wiring harness 30 and battery power pack module 32 for powering two 1-watt direct current light emitting diode lighting devices 34 held by standard screw type lamp sockets 36 extending downwardly into the lighting compartment 26 from an upper part of the retaining wall 28.

Figure 2:
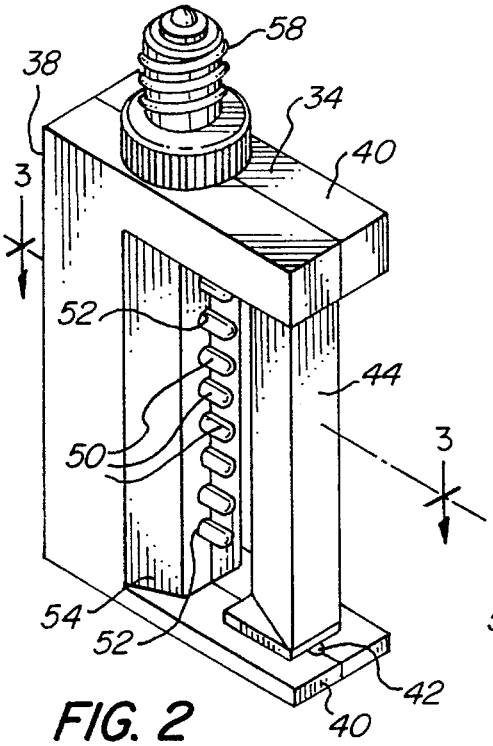
FIG. 2 is a perspective view of one of the light emitting diode lighting devices from the exit sign of FIG. 1.
Figure 3:
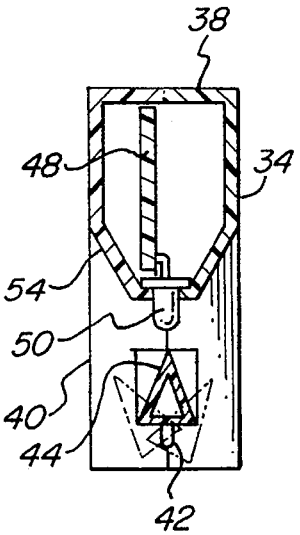
FIG. 3 is a cross-sectional view of the light emitting diode lighting device taken along the 3—3 line of FIG. 2 and illustrating the adjustability of the wedge reflector in phantom line.
Figure 4:
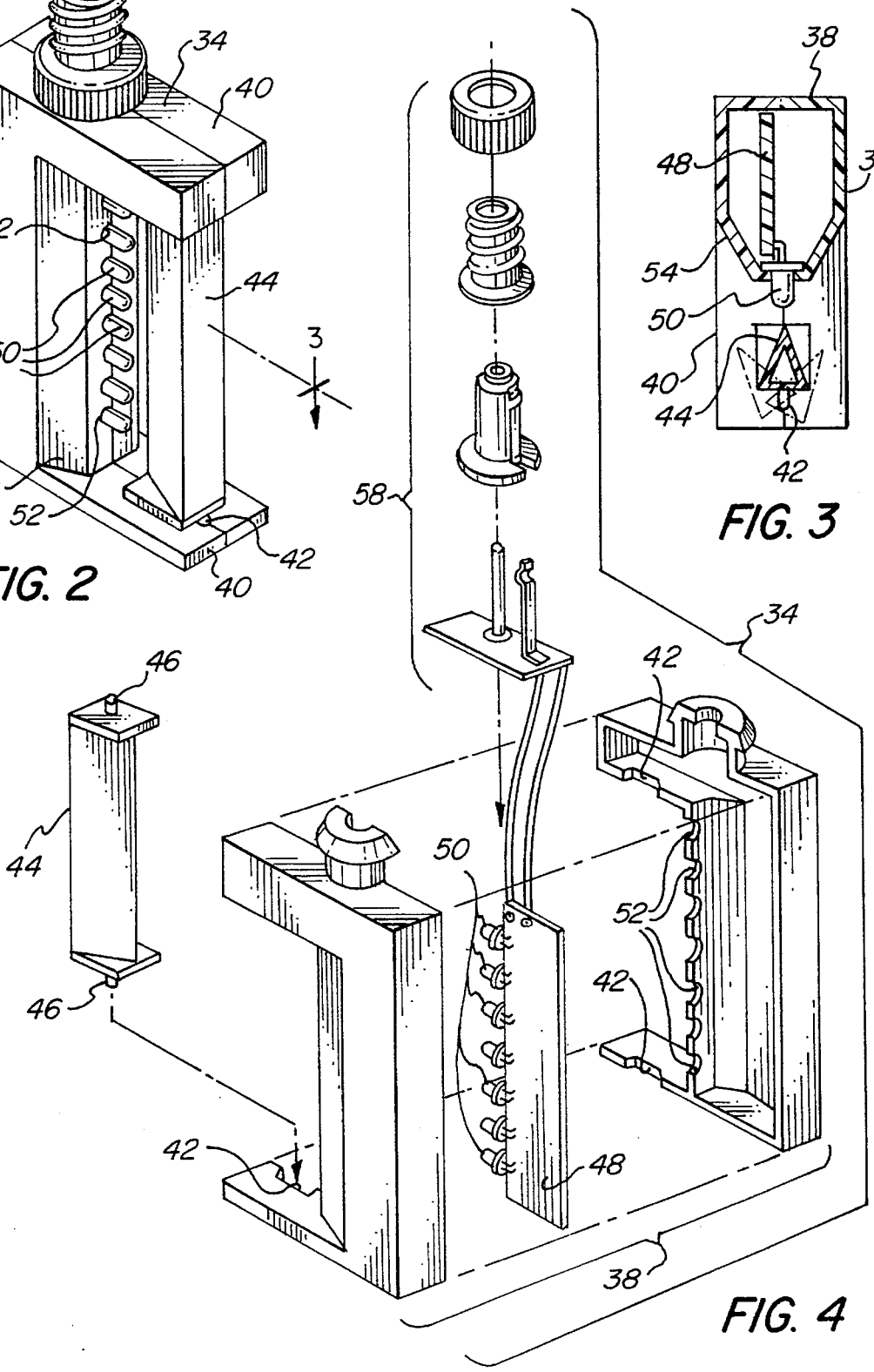
FIG. 4 is an exploded perspective view of the light emitting diode lighting device of FIG. 2.

Referring to FIGS. 2–4 taken in conjunction with FIG. 1, each of the light emitting diode lighting devices 34 has an elongated plastic housing 38 having a pair of parallel legs 40 extending from one side thereof which each have an elongated slot 42 defined therein. Positioned between the legs 40 is a moveable wedge member 44 having pins 46 on either end thereof. The pins 46 mount in the elongated slots 42 to permit the wedge member 44 to move toward and away from the plastic housing 38 and rotate around the axis of the pins 46 as illustrated in FIG. 3. Inside the elongated plastic housing 38 is a printed circuit board 48 with a plurality of light emitting diodes 50 thereon. The light emitting diodes 50 are positioned to extend toward the wedge member 44 from a plurality of apertures 52 in a pedestal portion 54 of the elongated plastic housing 38.

Figure 5:
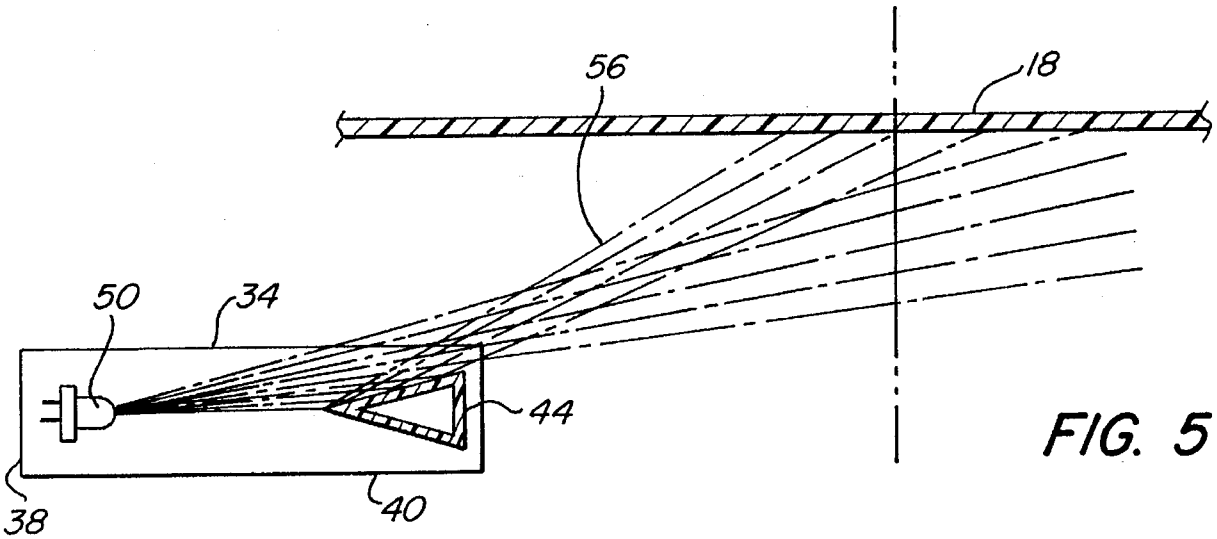
FIGS. 5 and 6 are illustrations of the illumination pattern of the exit sign of FIG. 1 as viewed from above.
Figure 6:
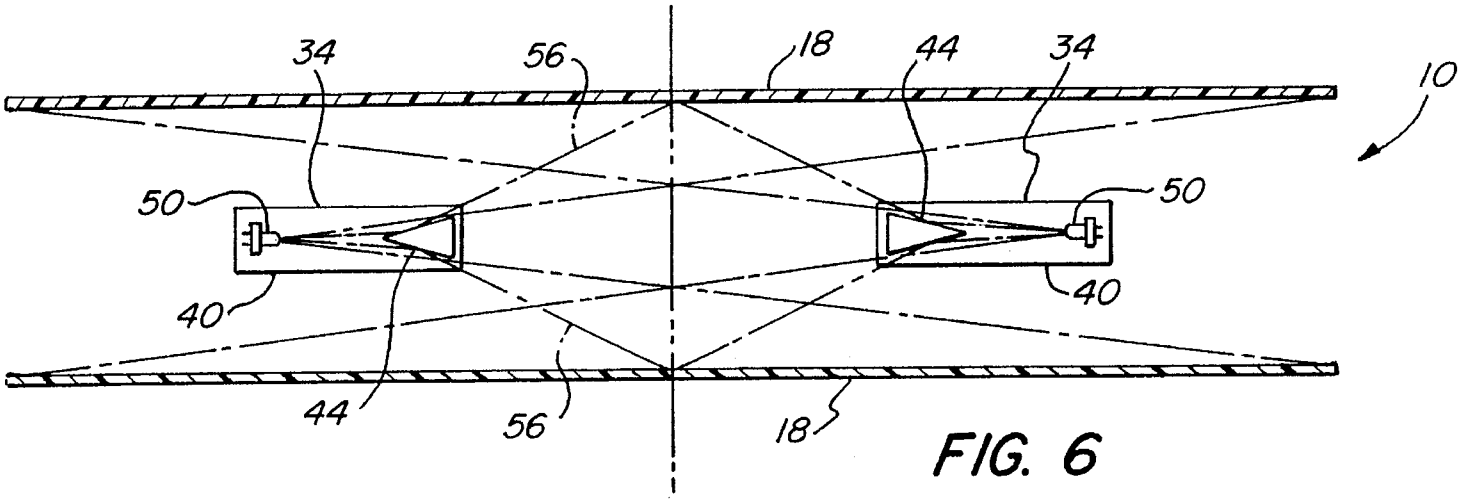

The wedge member 44 is designed to direct light rays 56 from the light emitting diodes 50 in an appropriate illumination pattern as shown in FIGS. 5–6 to provide full illumination for the stencil 18. Through cooperation of the pins 46 and the slots 42, the wedge member 44 can be rotated and also moved toward and away from the light emitting diodes 50 to make appropriate adjustments to the illumination pattern for the stencil 18. The plastic housing 38 and the wedge member 44 are made of or coated with a reflective material so as to provide the proper amount of illumination.

As illustrated in FIGS. 1 and 5–6, in order for light rays from the light emitting diode lighting devices 34 to evenly illuminate the stencil 18 when they pass through the diffuser 20, the light emitting diode lighting devices 34 with the light emitting diodes 50 therein have to face one another. To obtain this type of alignment, the light emitting diode lighting devices 34 are provided with mounting base assemblies 58 (one shown in FIG. 4) which permit adjustment of the elongated rectangular plastic housings 38 relative to the mounting base assemblies 58 once the assemblies 58 are fully inserted and tightened into their respective screw-type lamp sockets 36. The adjustment of the elongated rectangular plastic housings 38 relative to the mounting base assemblies 58 is described in U.S. Pat. No. 5,416,679, entitled MOUNTING BASE ASSEMBLY FOR A LIGHTING DEVICE USED IN AN EXIT SIGN by inventors Charles R. Ruskouski and James J. Burnes, which is hereby incorporated by reference, particularly, FIGS. 3 and 4 and the description thereof.

Figure 7:
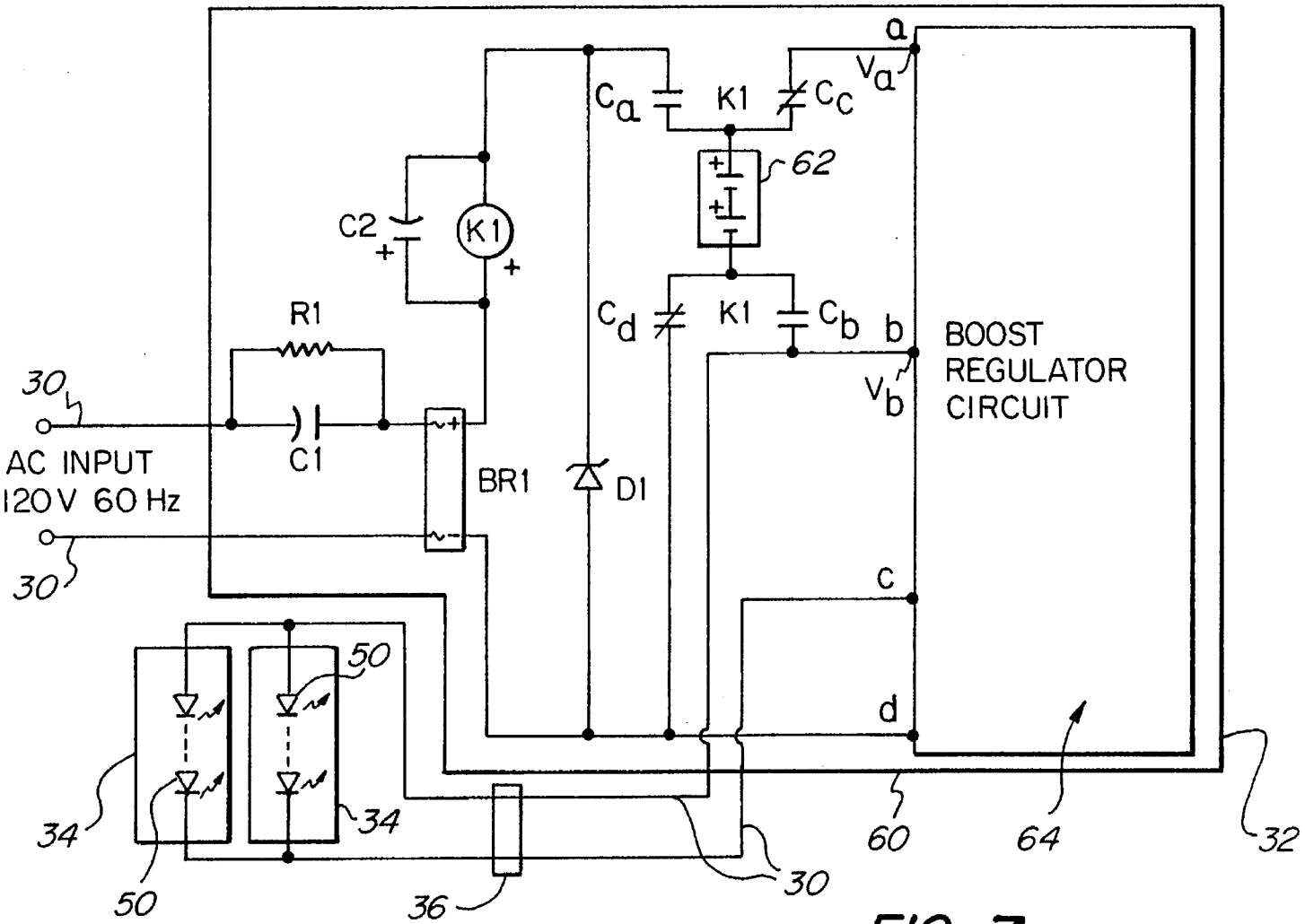
FIGS. 7 and 7A are an electrical schematic for the exit sign of FIG. 1.
Figure 7A:
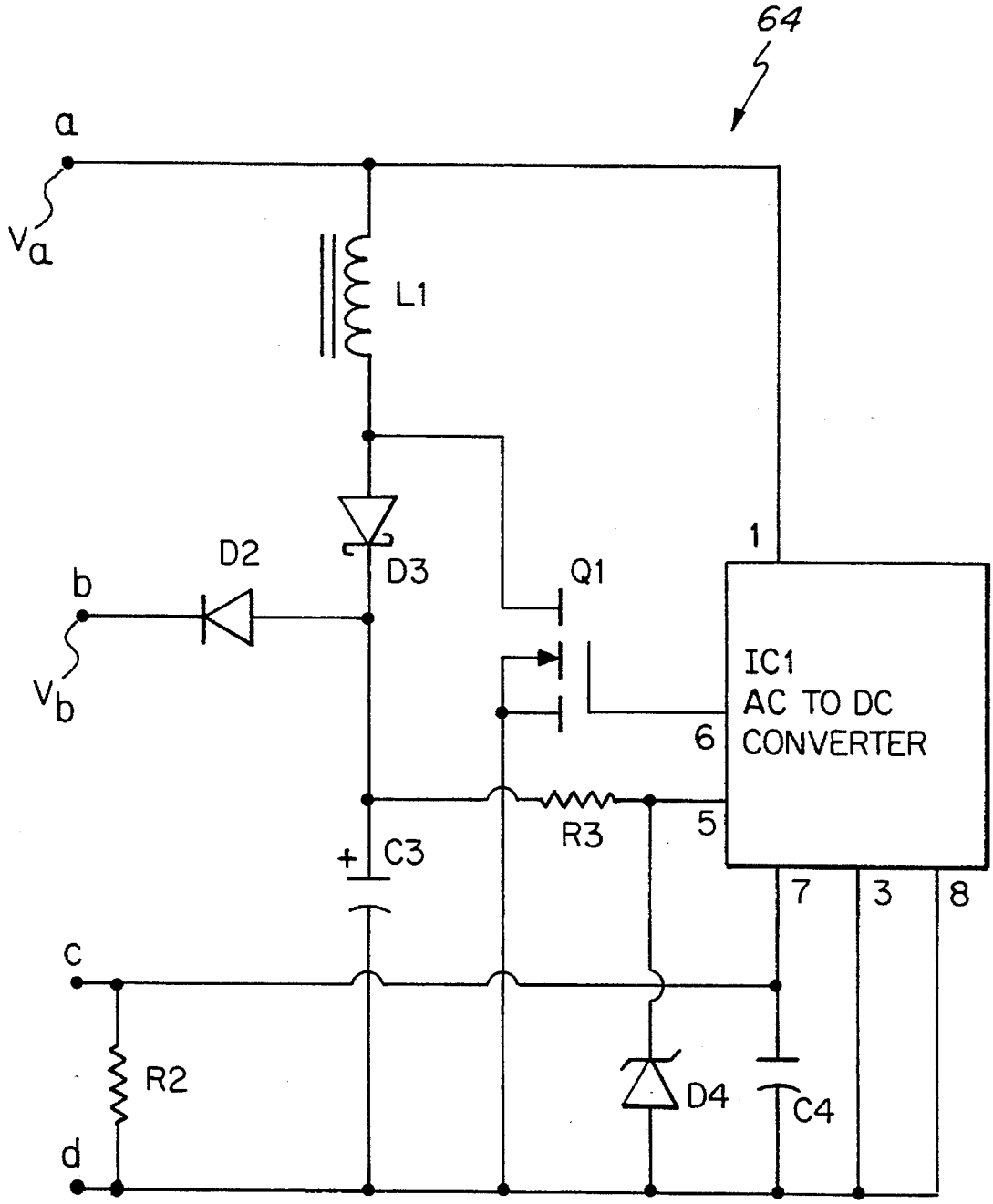

Turning now to FIGS. 7 and 7A taken in conjunction with FIG. 1, to power the light emitting diode lighting devices 34, the utility power (120 VAC) is provided to the wiring harness 30 through electrical leads (not shown) which extend into an electrical junction box (not shown) found in the ceiling or wall of the building. The battery power pack module 32 is electrically connected to the wiring harness 30 and incorporates a battery charger and converter circuit 60. The circuit 60 is designed in a manner well known to those skilled in the art to rectify the utility power into direct current and charge an auxiliary rechargeable battery pack 62. The circuit 60 also is designed to switch between the primary alternating current power supply and the emergency direct power supply provided by the rechargeable battery pack if the alternating current power supply fails as would be the case during a utility power outage.

During normal operation, utility power on the wiring harness 30 energizes the light emitting diodes 50 and maintains a charge on the battery pack 62 and, during emergency operation when the utility power fails, the battery pack 62 energizes the light emitting diodes 50 until utility power resumes on the wiring harness 30.

When the utility power is supplied on the wiring harness 30, the alternating current is first passed through a current limiting resistor R1 and capacitor C1 and is then passed through a bridge circuit BR1 which rectifies the alternating current into direct current. If the utility power fails, the current in the capacitor C1 discharges through the resistor R1 to prevent electrical shocks. The direct current from the bridge circuit BR1 initially flows through a Zener diode D1 and energizes a coil K1 for closing contacts Ca and Cb and opening contacts Cc and Cd so that the battery pack 62 is connected in series with the coil K1 and the light emitting diodes 50, which are electrically connected in series, parallel or series parallel to one another. This maintains the closure of the contacts Ca and Cb, charges the battery pack 62 and energizes the light emitting diodes 50. At this point, no current flows through the Zener diode D1.

When the utility power is not supplied on the wiring harness 30, the coil K1 is deenergized, which opens the contacts Ca and Cb and closes the contacts Cc and Cd. This causes the battery pack 62 to discharge through a boost regulator circuit 64 (shown in detail in FIG. 9A) which boosts the battery voltage to a level sufficient to operate the light emitting diodes 50. For example, when the utility power is off, the direct current flows from the positive side of the battery pack 62 through the contact Cc, into point a and out point b of the boost regulator circuit 64, where the output voltage Vb is greater than the input voltage Va. The direct current then flows through the light emitting diodes 50, which are electrically connected across points b and c as shown, into point c and out point d of the boost regulator circuit 64, through the contact Cd and back to the negative side of the battery pack 62.

The boost regulator circuit 64 is well known in the art and one example is shown in FIG. 7A. It has an input voltage Va coupled to pin 1 of a DC-to-DC converter IC1 and to one side of an inductor L1. The other side of the inductor L1 is coupled to a drain of a FET transistor Q1 having its gate coupled to pin 6 and its source coupled to ground. A Schottky diode D3 is connected between the drain of the FET transistor Q1 and an output voltage Vb. In operation, the direct current passes into the boost regulator circuit 64 at point a discharges through the inductor L1 and the diodes D2 and D3, and passes from the boost regulator circuit 64 at point b to the light emitting diodes 50. The inductor L1, the DC-to-DC converter IC1, the FET transistor Q1, the diodes D2 and D3 combined to boost the output voltage Vb so it is greater than the input voltage Va needed to provide the direct current to the light emitting diodes 50. Upon return from the light emitting diodes 50, the direct current passes into the boost regulator circuit 64 at point c, through a resistor R2 and passes from the boost regulator circuit 64 at point d. From there, the direct current passes through the contact Cd and back to the negative side of the battery pack 62 to complete the circuit. The Zener diode D4 fixes the voltage at pin 5 of the DC-to-DC converter IC1. A capacitor C4 filters out undesirable voltage surges at point c of the boost regulator circuit 64, pin 3 is a ground connection for the convertor IC1 and pin 8 is grounded since it is not being used.

Figure 8:
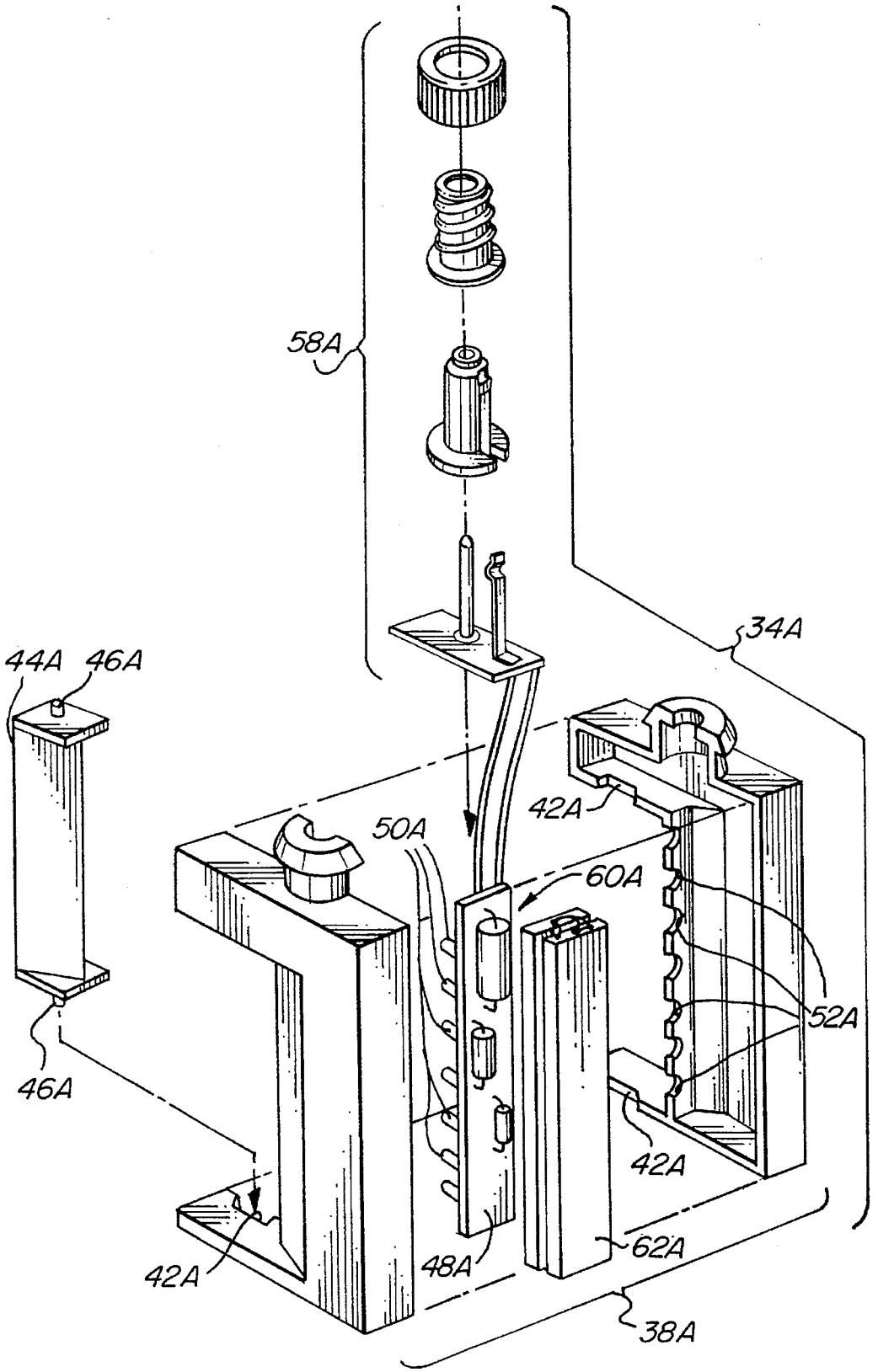
FIG. 8 an exploded perspective view of an alternative arrangement for the light emitting diode lighting device of FIG. 2 which has electronic circuitry mounted therein.
Figure 9:
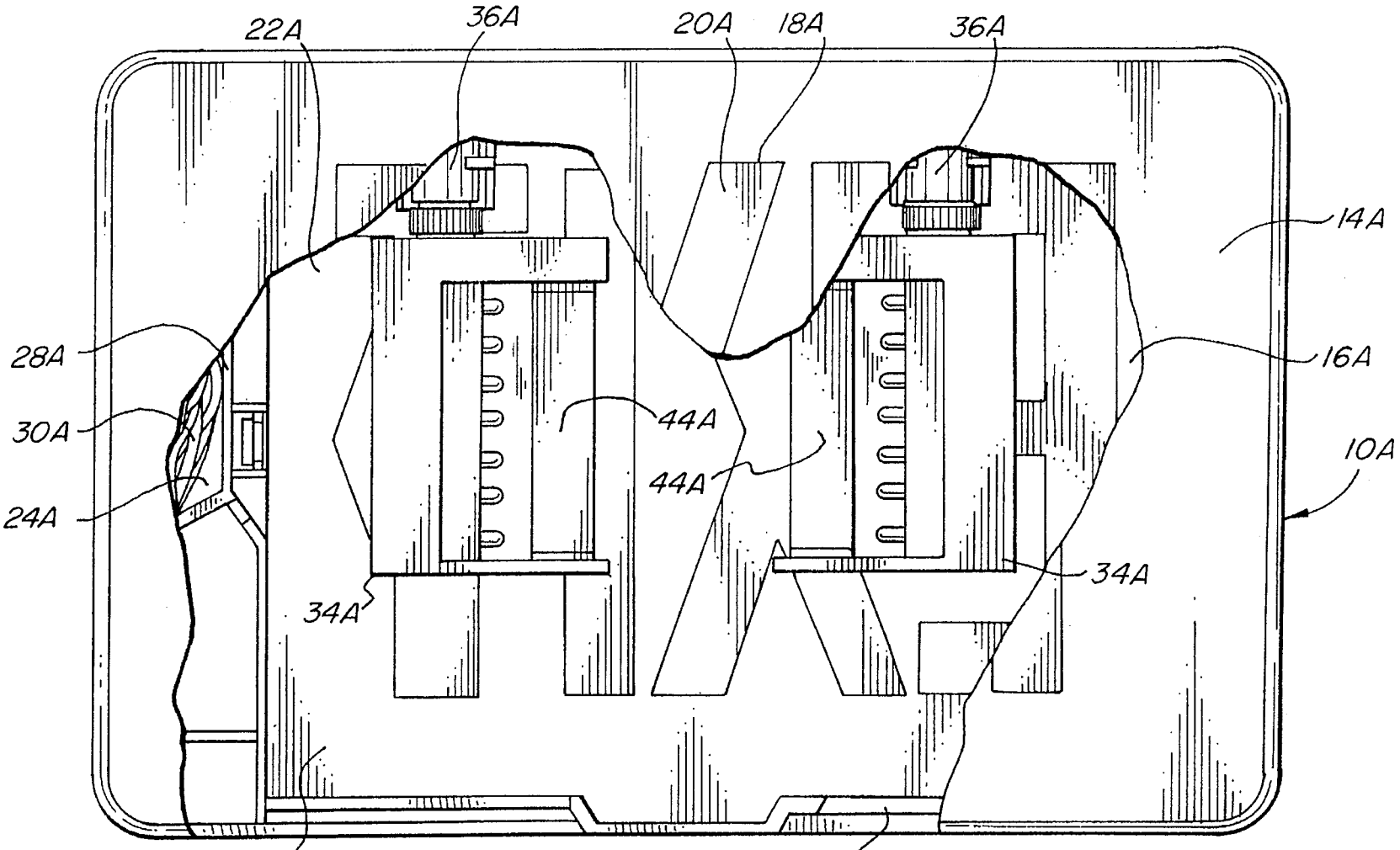
FIG. 9 side elevational view of an exit sign housing with portions removed and broken away to illustrate internal structure including two light emitting diode lighting devices as shown in FIG. 8.
Figure 10:
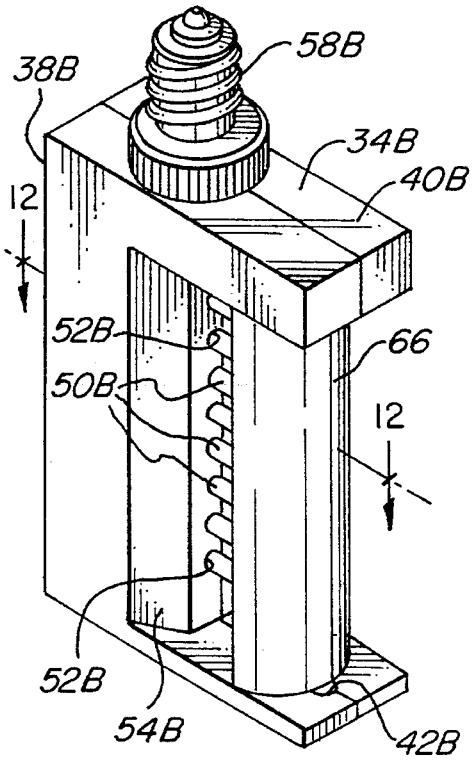
FIG 10 is a perspective view of a second embodiment of the light emitting diode lighting device of the present invention which uses a parabola shaped reflector.
Figure 11:
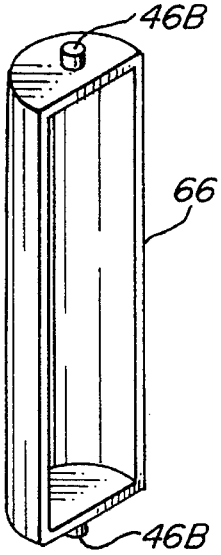
FIG. 11 is a perspective view of the parabola shaped reflector of the second embodiment of the light emitting diode lighting device as shown in FIG. 10.

Turning now to FIGS. 8–10, therein is illustrated an alternative mounting arrangement for the electronic circuitry of the present invention. In this alternative arrangement, essentially all components are identical to the arrangement in FIGS. 1–7A and like components have been designated with like reference numerals except for the addition of the reference character A.

As shown in FIG. 8, a circuit board 48A is mounted inside an elongated plastic housing 38A and incorporates an appropriate battery charger and converter 60A designed in a manner well known to those skilled in the art (see FIGS. 7 and 7A) to rectify the alternating current and to charge an auxiliary rechargeable battery pack 62A as well as to switch between the primary alternating current power supply and the emergency direct power supply provided by the rechargeable battery pack 62A if the alternating current power supply fails as would be the case during a utility power outage. The rechargeable battery pack 62A is also arranged inside the elongated plastic housing 38A. As shown in FIG. 9, with two light emitting diode lighting devices 34A, each having their own circuit 60A and battery pack 62A, the battery power pack module 32 of FIG. 1 can be eliminated.

Figure 12:
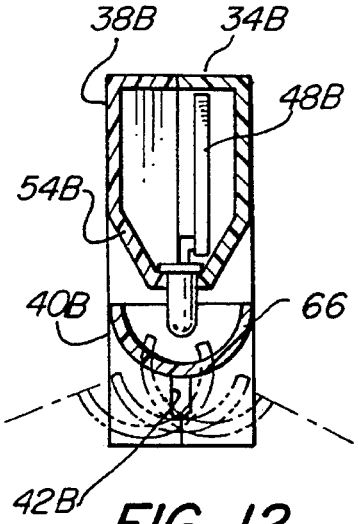
FIG. 12 is a cross-sectional view of the second embodiment of the light emitting diode lighting device taken along the 12—12 line of FIG. 10.

Turning now to FIGS. 11–15, therein is illustrated a second embodiment of the light emitting diode lighting device of the present invention. In this second embodiment, essentially all components are identical to the arrangement in FIGS. 1–7A and like components have been designated with like reference numerals except for the addition of the reference character B. The difference between the first and second embodiments is the substitution of a parabola member 66 for the wedge member 44. As shown in FIG. 12, the parabola member 66 is moveable in the same manner as the wedge member 44.

Figure 13:
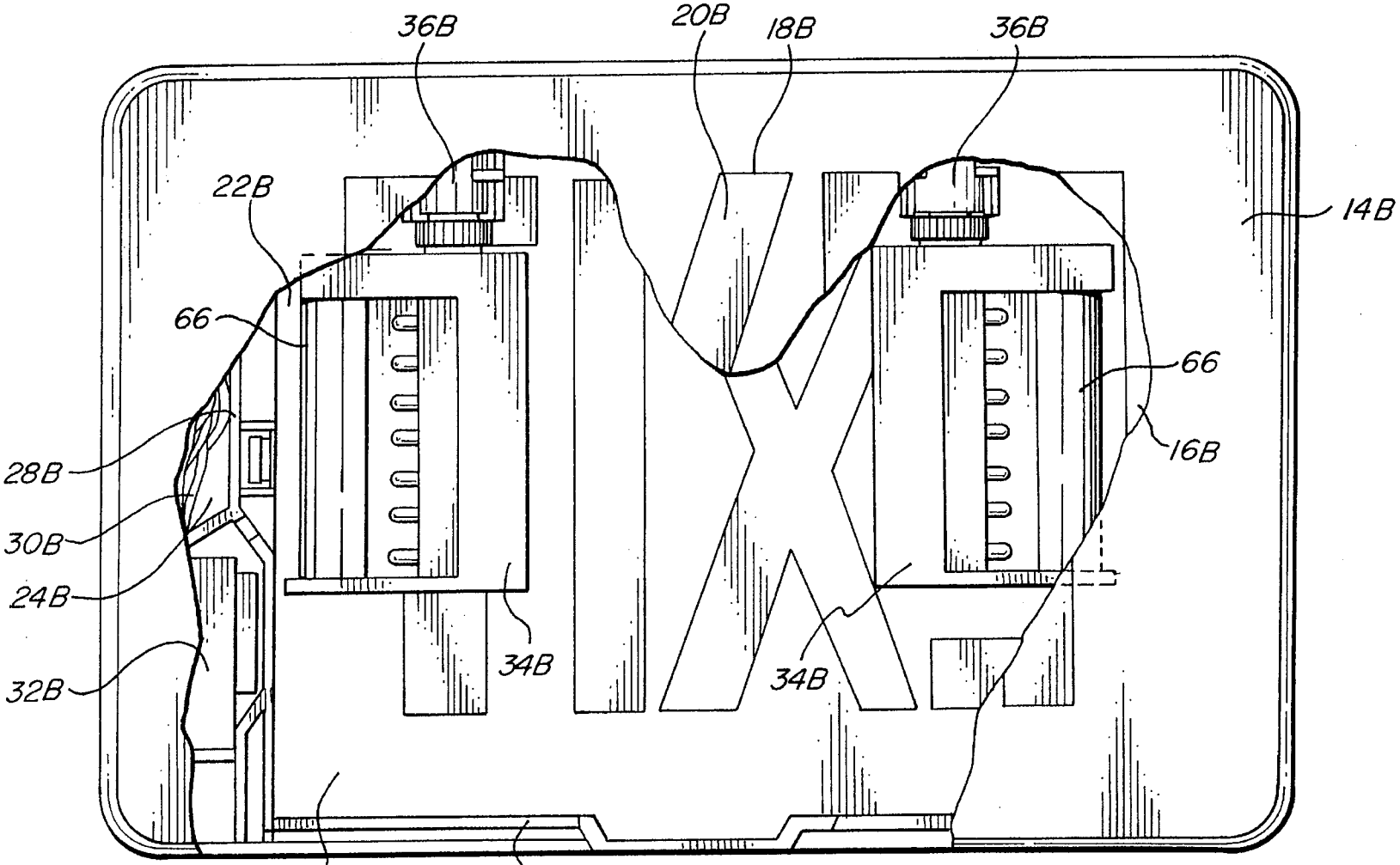
FIG. 13 is a side elevational view of an exit sign housing with portions removed and broken away to illustrate internal structure including two light emitting diode lighting devices according to the second embodiment of the invention as shown in FIG. 11.
Figure 14:
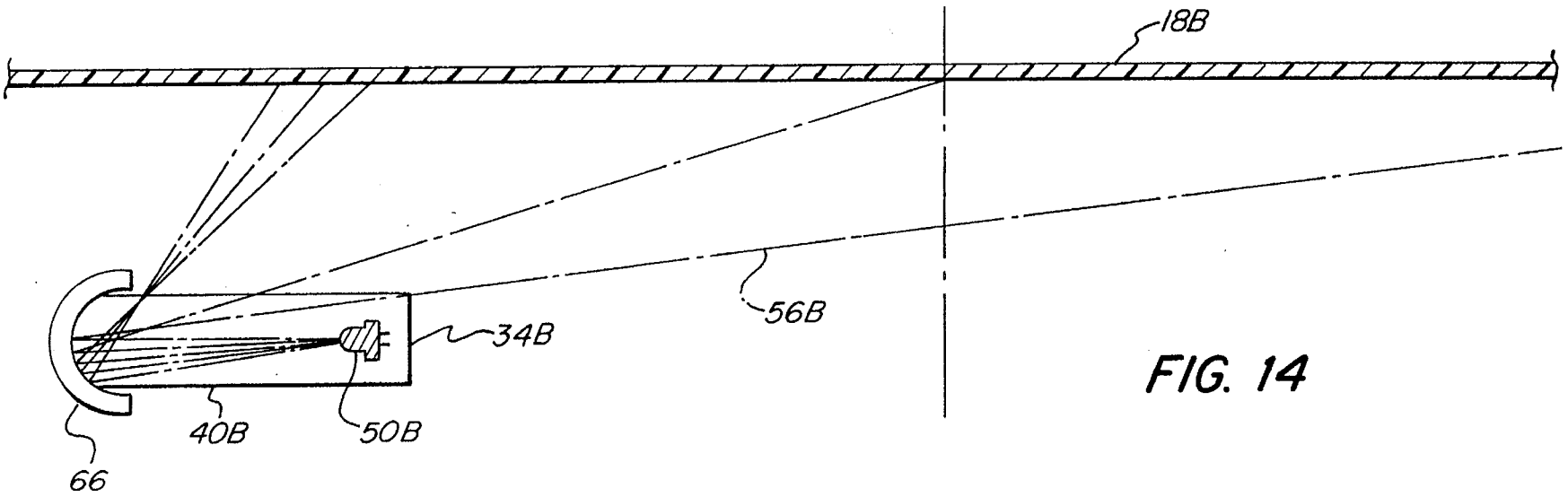
FIGS. 14 and 15 are illustrations of the illumination patterns of the exit sign of FIG.13 as view from above.
Figure 15:
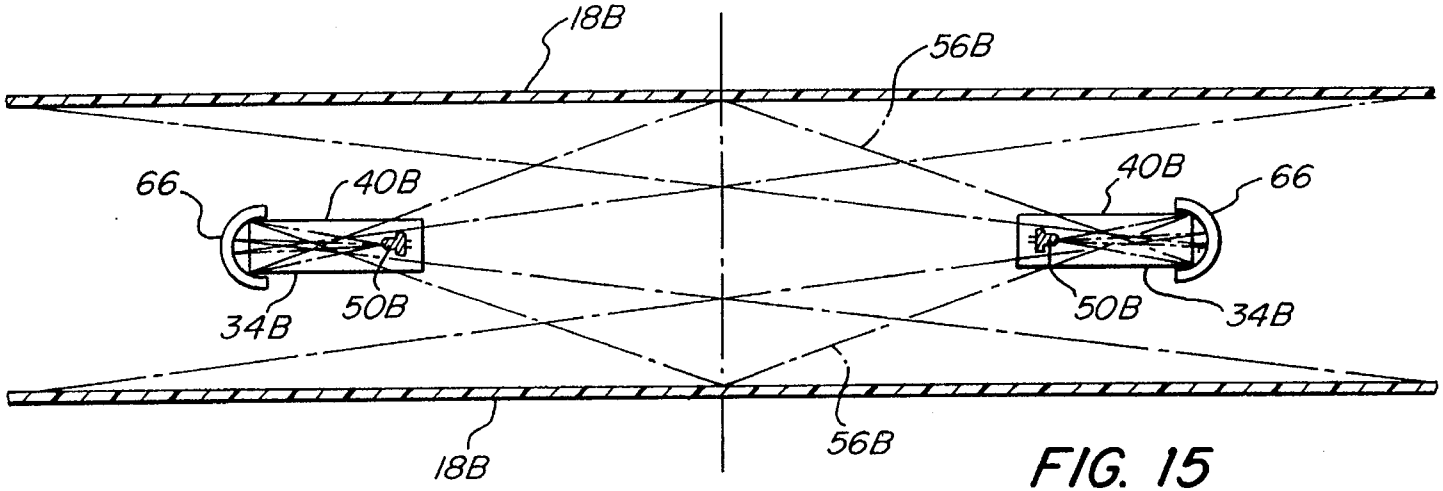

Referring to FIGS. 13–15, in order to accommodate the different reflective capabilities of the parabola member 66 verses the wedge member 44, the light emitting diode lighting devices 34B are aligned with their light emitting diodes 50B pointing away from one another. Light rays 56B captured in the parabola members 66 are directed to illuminate the stencils 18B.

With regard to powering the light emitting diode lighting device 34B, it will be appreciated by those skilled in the art that the second embodiment can be powered in the same manner as the first embodiment, i.e., externally with battery pack module (FIGS. 7 and 7A) or internally (FIG. 8).

It will therefore be seen from the above that the present invention provides an effective light emitting diode lighting device within an exit sign. The exit sign using the light emitting diode lighting devices has the same amount of illumination as found in exit signs using traditional incandescent lamps while at the same time greatly reducing power consumption.

It will thus be seen that the objects set forth above, among those made apparent from the preceding description, are efficiently attained and, since certain changes may be made in the above product without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the invention which, as a matter of language, might be the to fall therebetween.

What is claimed is:

1. A lighting device for illuminating indicia of an exit sign having an enclosure and a primary electrical power source, comprising:

(a) a housing;

(b) illumination means in said housing to be powered by the primary electrical power source, said illumination means including a plurality of light emitting diodes extending from said housing; and (c) light directing means connected to paid housing and spaced from said plurality of light emitting diodes for directing light from said light emitting diodes into the enclosure to illuminate the indicia of the exit sign.

2. The lighting device in accordance with 'claim 1, wherein said light directing means has a wedge shape.

3. The lighting device in accordance with claim 1, wherein said light directing means has a parabola shape.

4. The lighting device in accordance with claim 1, wherein said light directing means is moveable relative to said light emitting diodes to obtain various illumination patterns.

5. The lighting device in accordance with claim 1, wherein said housing has two legs extending therefrom and said light directing means extends between said two legs.

6. The lighting device in accordance with claim 5, wherein said light directing means is connected to said legs for movement relative to said light emitting diodes to obtain various illumination patterns.

7. The lighting device in accordance with claim 6, wherein said light directing means is connected to said legs for pivotal and rectilinear movement relative to said light emitting diodes.

8. The lighting device in accordance with claim 1, wherein said plurality of light emitting diodes are mounted on a printed circuit board.

9. The lighting device in accordance with claim 8, wherein said housing has an enclosure therein in which said printed circuit board is positioned.

10. The lighting device in accordance with claim 8, wherein said printed circuit board is part of said illumination means.

11. The lighting device in accordance with claim 8, wherein said printed circuit board has electrical components thereon for said illumination means.

12. The lighting device in accordance with claim 1, further including an emergency electric power supply in said housing to provide auxiliary power to said light emitting diodes in the event of failure of the primary electrical power source.

13. The lighting device in accordance with claim 12, wherein said emergency electric power supply includes at least one rechargeable battery, a charging device for keeping said at least one rechargeable battery fully charged during periods of nonuse and circuit for switching between said emergency electric power supply and the primary electrical power source.

14. The exit sign in accordance with claim 1, further including a rectifying circuit in said housing for rectifying electrical power from the primary electrical power source into direct current for powering said illumination means.

15. The exit sign in accordance with claim 1, further including a mounting base assembly on said housing for electrically connecting said illumination means to the exit sign, said mounting base assembly matingly received in an electrical socket of the exit sign through relative rotational and axial movement therebetween.

16. The lighting device in accordance with claim 15, wherein said mounting base assembly permits orientation of said housing relative to said mounting base assembly.

17. An exit sign connectable to a primary electrical power source, comprising:

(a) a sign housing defining an enclosure therein and having indicia to be illuminated;

(b) a primary electrical power circuit adapted to be connected to the primary electrical power source;

(c) at least one lighting device electrically connected to said primary electrical power circuit and positioned within said enclosure for illuminating said indicia, each lighting device comprising:

(i) a lighting device housing having an enclosure, (ii) illumination means in said lighting device housing, said illumination means including a plurality of light emitting diodes extending from said lighting device housing, and (iii) light directing means connected to said housing and spaced from said plurality of light emitting diodes for directing light from said light emitting diodes into the enclosure to illuminate said indicia of said sign housing.

18. The exit sign in accordance with claim 17, wherein said light directing means has a wedge shape.

19. The exit sign in accordance with claim 17, wherein said light directing means has a parabola shape.

20. The exit sign in accordance with claim 17, wherein said light directing means is moveable relative to said light emitting diodes to obtain various illumination patterns.

21. The exit sign in accordance with claim 17, wherein each said lighting device housing has two legs extending therefrom and said light directing means extends between said two legs.

22. The exit sign in accordance with claim 21, wherein said light directing means is connected to said legs for movement relative to said light emitting diodes to obtain various illumination patterns.

23. The exit sign in accordance with claim 22, wherein said light directing means is connected to said legs for pivotal and rectilinear movement relative to said light emitting diodes.

24. The exit sign in accordance with claim 17, wherein said plurality of light emitting diodes are mounted on a printed circuit board.

25. The exit sign in accordance with claim 24, wherein said printed circuit board is positioned in said enclosure of said lighting device housing.

26. The exit sign in accordance with claim 24, wherein said printed circuit board is part of said illumination means.

27. The exit sign in accordance with claim 24, wherein said printed circuit board has electrical components thereon for said illumination means.

28. The exit sign in accordance with claim 17, further including an emergency electric power supply to provide auxiliary power to said light emitting diodes in event of failure of the primary electrical power source.

29. The exit sign in accordance with claim 28, wherein said emergency electric power supply includes at least one rechargeable battery, a charging device for keeping said at least one rechargeable battery fully charged during periods of nonuse and circuit for switching between said emergency electric power supply and the primary electrical power source.

30. The exit sign in accordance with claim 28, wherein said emergency electrical power supply is mounted within said lighting device housing.

31. The exit sign in accordance with claim 28, wherein said emergency electric power circuit operationally connected to said primary electric power circuit to detect failure of the primary electrical power source and thereafter provided auxiliary power to said at least one lighting device.

32. The exit sign in accordance with claim 17, further including a rectifying circuit in said lighting device housing for rectifying electrical power from the primary electrical power source into direct current for powering said illumination means.

33. The exit sign in accordance with claim 17, a mounting base assembly on said lighting device housing for electrically connecting said illumination means to an electrical socket in said lighting device housing, said mounting base assembly matingly received in said electrical socket through relative rotational and axial movement therebetween.

34. The exit sign in accordance with claim 33, wherein said mounting base assembly permits orientation of said lighting device housing relative to said mounting base assembly.

35. The exit sign in accordance with claim 17, wherein said at least one lighting device is two lighting devices spaced from one another within said enclosure to fully illuminate said indicia.

36. The exit sign in accordance with claim 35, wherein said two lighting devices have their respective light emitting diodes facing one another.

37. The exit sign in accordance with claim 35, wherein said two lighting devices have their respective light emitting diodes facing away from one another.

* * * * *